US009655477B1

(12) United States Patent
Addesso

(10) Patent No.: US 9,655,477 B1
(45) Date of Patent: May 23, 2017

(54) BATHER FOR INFANTS AND TODDLERS

(71) Applicant: Judy Addesso, North Babylon, NY (US)

(72) Inventor: Judy Addesso, North Babylon, NY (US)

( * ) Notice: Subject to any disclaimer, the term of this patent is extended or adjusted under 35 U.S.C. 154(b) by 0 days.

(21) Appl. No.: 14/822,878

(22) Filed: Aug. 10, 2015

Related U.S. Application Data

(60) Provisional application No. 62/034,977, filed on Aug. 8, 2014.

(51) Int. Cl.
*A47K 3/12* (2006.01)

(52) U.S. Cl.
CPC ..... *A47K 3/127* (2013.01)

(58) Field of Classification Search
CPC ..... A47K 3/024; A47K 3/122; A47K 3/034; A47K 3/127; A47K 3/064; A47K 3/074
See application file for complete search history.

(56) References Cited

U.S. PATENT DOCUMENTS 5,063,621 A * 11/1991 Sellars ..... A47K 3/12 4/568
7,065,805 B1 * 6/2006 Sundberg ..... A47K 3/127 297/256.12
2014/0259360 A1 * 9/2014 Yu ..... A47K 3/024 4/572.1

* cited by examiner

*Primary Examiner* — Janie Loeppke

(57) ABSTRACT

A super deluxe bather for infants and toddlers for a comfortable, relaxed and safe bath. The super deluxe bather includes a soft mesh placed on a seat of the super deluxe bather and a frame that adjusts for sitting position and lying position of a child. Further, the super deluxe bather includes a headrest that is adjustable based on the size of the child. Furthermore, the super deluxe bather includes a plurality of armrests to support the arms of the child and a base portion. Moreover, the super deluxe bather includes folds and locks of the super deluxe bather for easy convenient storage.

20 Claims, 9 Drawing Sheets

BATHER FOR INFANTS AND TODDLERS

CROSS-REFERENCE TO RELATED APPLICATION

The present application claims priority to U.S. provisional patent application Ser. No. 62/034,977, filed on Aug. 8, 2014.

TECHNICAL FIELD

Embodiments of the disclosure relate generally to the improvement in bathtubs. Embodiments relate more particularly to provide a super deluxe bather that includes adjustable and removable components for a relaxed, comfortable and safe bath.

BACKGROUND

Bathtubs are ordinarily constructed for comfort, having a smooth surface to hold water and generally installed in a bathroom. Most modern bathtubs are made of acrylic or fiberglass. Specifically, a baby bathtub is one that is used for bathing infants, who are not old enough to sit up on their own.

Generally, a baby's muscles are not strong enough to support its body, so it is vital for a parent to carefully hold the baby during a bath. When the baby is given a bath, the parent must hold the baby with one arm and bath it with the other arm. The process of bathing a baby may cause pain to the baby's back, arms and neck and even hamper the parent's comfort as well. Additionally, the parent may also experience pain in the back, neck and arms.

Infants and toddlers often find bathing to be uncomfortable because their arms become tired and sore from holding their bodyweight up in the tub. Furthermore, especially young children often get a sore neck trying to hold their head steady in a tilted upwards position for rinsing. Therefore, parents help young children with bathing, but parents may suffer from back pain due to leaning over and holding the child up.

Infant bathers are known in the prior art. Some such bathers comprise a frame that adjusts for sitting and lying down. Other such bathers comprise an extended headrest for supporting the head of an infant. However, these bathers are not adjustable based on the size of the child.

In the light of the above discussion, there appears to be a need for a bathtub that provides infants and toddlers with a comfortable, safe and bathing experience.

OBJECT OF INVENTION

The principal object of the embodiments herein is to provide a super deluxe bather that has adjustable and removable headrest and armrests to accommodate infants and toddlers.

Another object of the embodiments herein is to allow parents use both their hands to bathe their child rather than holding up the body and neck underneath a bathtub faucet.

Yet another object of the embodiments herein is to provide a mildew-resistant covering and extruded polystyrene foam for added comfort and utility.

SUMMARY

The above-mentioned needs are met by a super deluxe bather for infants and toddlers.

An example of a method for giving a comfortable and safe bath to a child using a super deluxe bather includes placing the super deluxe bather in a common bathtub and detaching a headrest and a plurality of armrests from the super deluxe bather. Further, the method includes adjusting the headrest and armrests to ensure proper accommodation of the child. Furthermore, the method includes laying the child on the super deluxe bather for a relaxed and comfortable bath. Moreover, the method includes allowing a parent of the child to use both hands to bathe the child.

An example of a super deluxe bather for infants and toddlers for a comfortable, relaxed and safe bath includes a soft mesh placed on a seat of the super deluxe bather and a frame that adjusts for sitting position and lying position of a child. Further, the super deluxe bather includes a headrest that is adjustable based on the size of the child. Furthermore, the super deluxe bather includes a plurality of armrests to support the arms of the child and a base portion. Moreover, the super deluxe bather includes folds and locks of the super deluxe bather for easy convenient storage.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the present disclosure.

Figure 5:
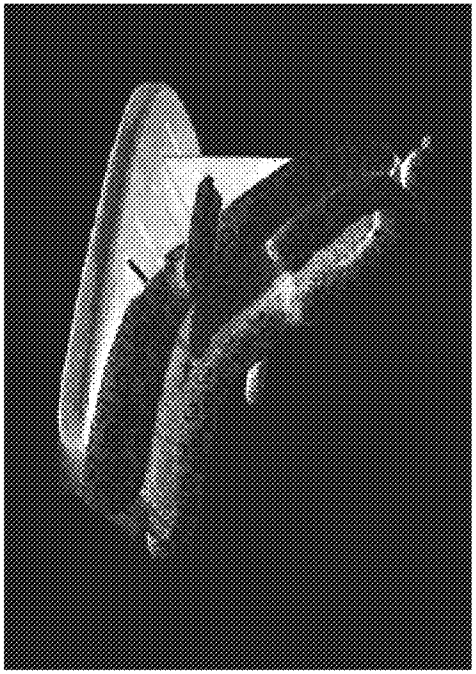
Figure 6:
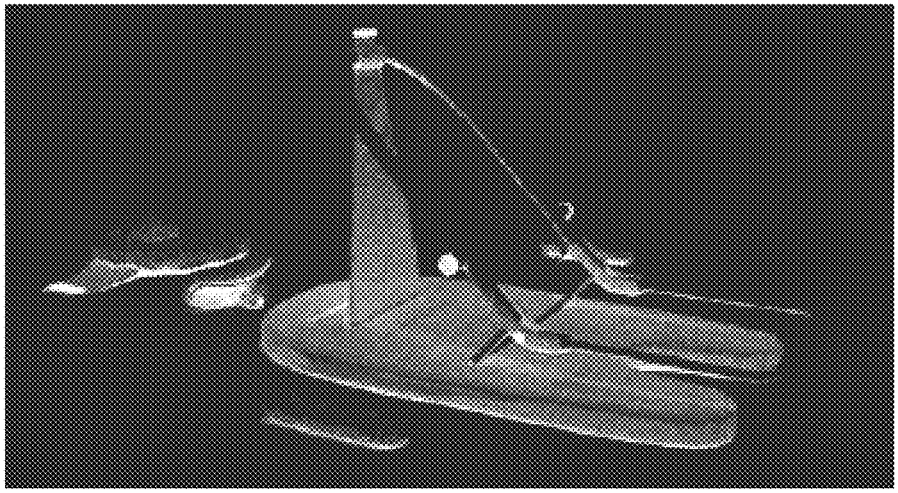
Figure 7:
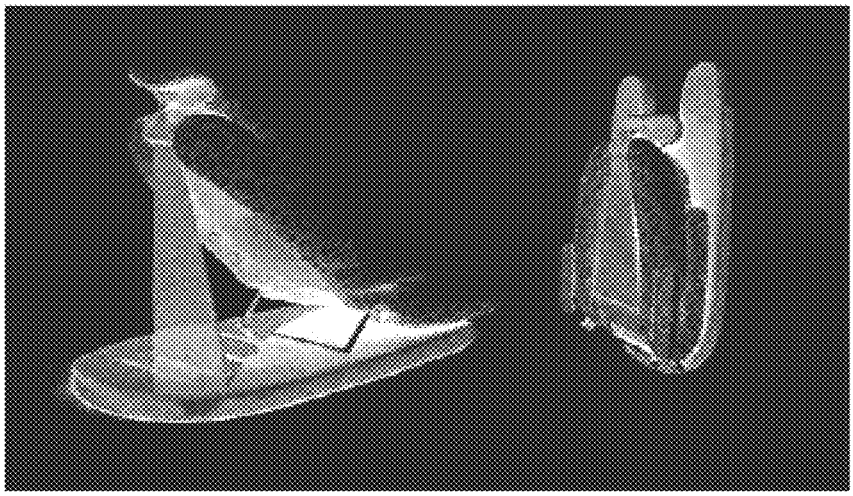
Figure 8:
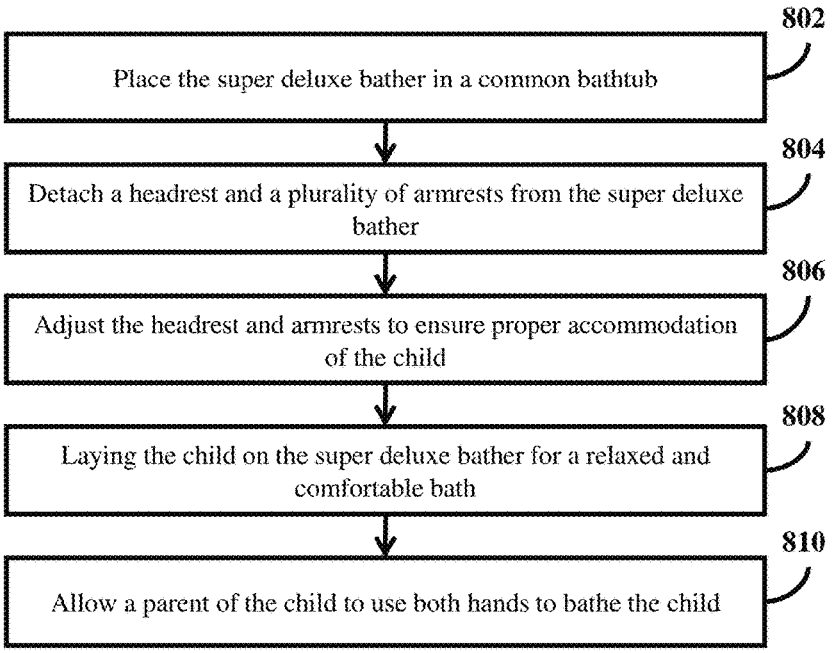

FIG. **4*a*** is a pictorial representation of an infant laying in the super deluxe bather for a bath, according to various embodiments described herein;

FIG. **4*b*** is a pictorial representation of a toddler laying in the super deluxe bather for a bath, according to various embodiments described herein;

FIG. 5 illustrates a full, close-up view of the super deluxe bather in its entirety, according to various embodiments described herein;

FIG. 6 illustrates how portions of the super deluxe bather can be detached for utility, according to various embodiments described herein;

FIG. 7 illustrates how the super deluxe bather can fold up for storage, according to various embodiments described herein; and FIG. 8 is a flow diagram illustrating a method for giving a bath to a child using a super deluxe bather, according to the embodiments as disclosed herein.

DETAILED DESCRIPTION OF THE EMBODIMENTS

The above-mentioned needs are met by a device known as a super deluxe bather for infants and toddlers to offer a more comfortable bathing experience. The device firmly and comfortably holds up a child's body and neck while bathing. The following detailed description is intended to provide example implementations to one of ordinary skill in the art, and is not intended to limit the invention to the explicit disclosure, as one of ordinary skill in the art will understand that variations can be substituted that are within the scope of the invention as described.

The super deluxe bather is herein referred to as "MA's Infant to Toddler Super Deluxe Bather".

Figure 1:
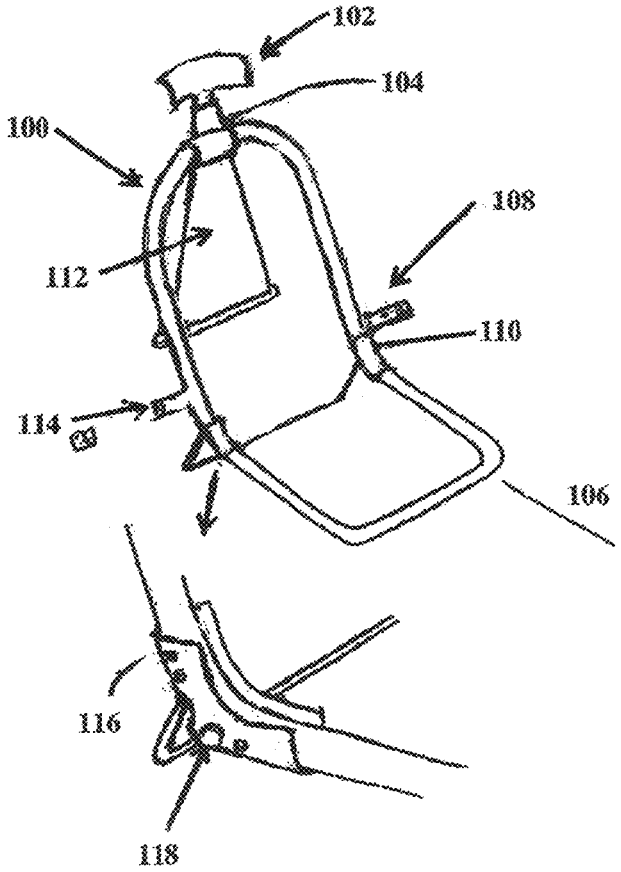
FIG. 1 illustrates a front view of a super deluxe bather, according to various embodiments described herein.

FIG. 1 illustrates a front view of a super deluxe bather, according to various embodiments described herein. The super deluxe bather 100 includes an adjustable headrest 102, a metal ring and rubber stopper 104, shows pin lock mechanism to adjust headrest in two settings to accommodate height of toddler and can be used to detach for infant use.

The metal frame is preferably composed of rust-proof metal. The back portion and the seat portion of the metal frame define an adjustable seat suitable for a toddler or an infant that is adapted to transit between several different positions. The headrest and armrests of the super deluxe bather are preferably covered in a comfortable foam material, such as extruded polystyrene. The headrest and armrests portions are also preferably detachable. Furthermore, the frame is covered in a washable, quick-drying and mildew-resistant material and the seat area is composed of a mesh material.

Typically, the headrest is adjustable and removable (for packaging purposes). The headrest is pulled out to adjust down for comfort. Similarly, the armrest is also adjustable and removable. The armrest is covered in quick drying fabric. Further, the headrest and the armrest are stuffed with Styrofoam pieces.

A soft mesh is placed in the center of the seat portion. The seat portion is composed of a machine washable fabric that is easy to remove and clean.

Further, the adjust for seat 110 includes a ping to hold frame 116 and a push button 118 to lock/unlock for easy storage.

Figure 2:
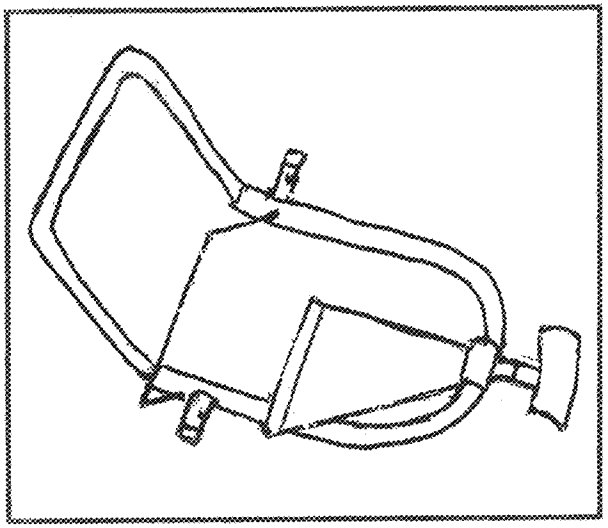
FIG. 2 illustrates a back view of the super deluxe bather, according to various embodiments described herein.

FIG. 2 illustrates a back view of the super deluxe bather, according to various embodiments described herein. The frame is composed from light weighted metal (preferably half an inch). The headrest and armrest is also composed with white adjustable light weight metal tubes and is attached to a curved metal for comfort. Further, all rust proof light weight metal is protected or surrounded by many tiny ball-like or extruded Styrofoam pieces or polystyrene foam and is covered with quick drying fabric.

In the depicted embodiment of the present disclosure, the headrest and the armrest components are adjustable through an adjustable locking pin mechanism.

An easy lock and fold mechanism is installed for easy storage and support.

Figure 3:
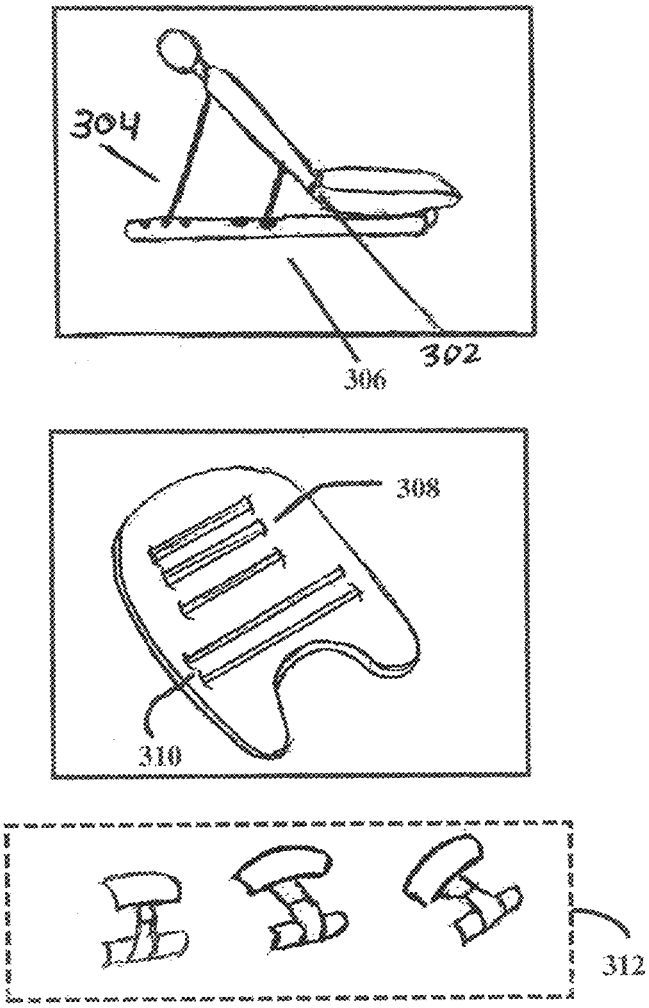
FIG. 3 illustrates views of the frame portion, according to various embodiments described herein.

FIG. 3 is illustrates views of the frame portion, according to various embodiments described herein. The back and seat portions of the metal frame 302 are connected through lock and fold hinges 304, thereby allowing the device to transit between several positions suitable for sitting or lying down. The metal frame 302 further comprises a base portion 306 that supports the device on the surface of the bathtub. The base portion 306 is composed of a non-skid material to ensure that the super deluxe bather does not dangerously shift during use.

The slots 308 represent the three different positions 312 of the headrest for neck/head. Similarly, the slots 310 represent two different positions for sitting up and lying down.

Figure 4A:
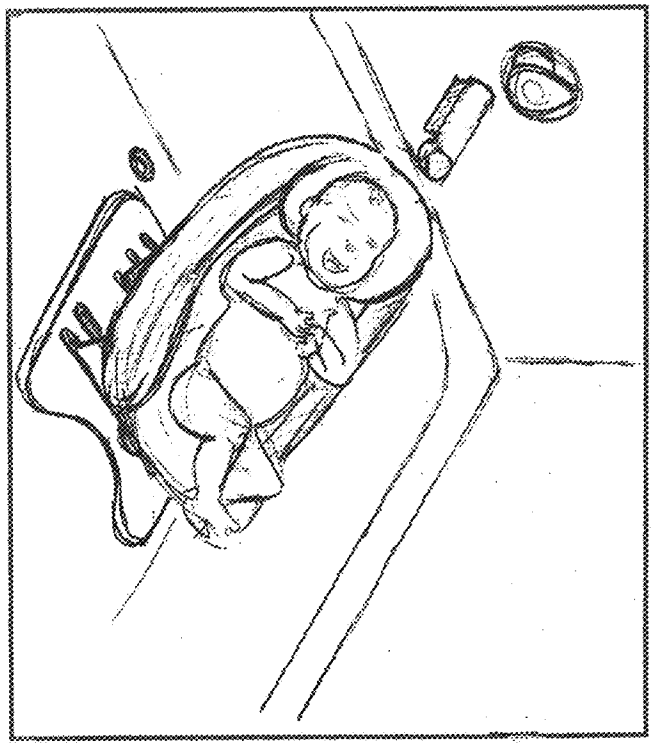

FIG. 4*a* is a pictorial representation of an infant lying in the super deluxe bather for a bath, according to various embodiments described herein.

Figure 4B:
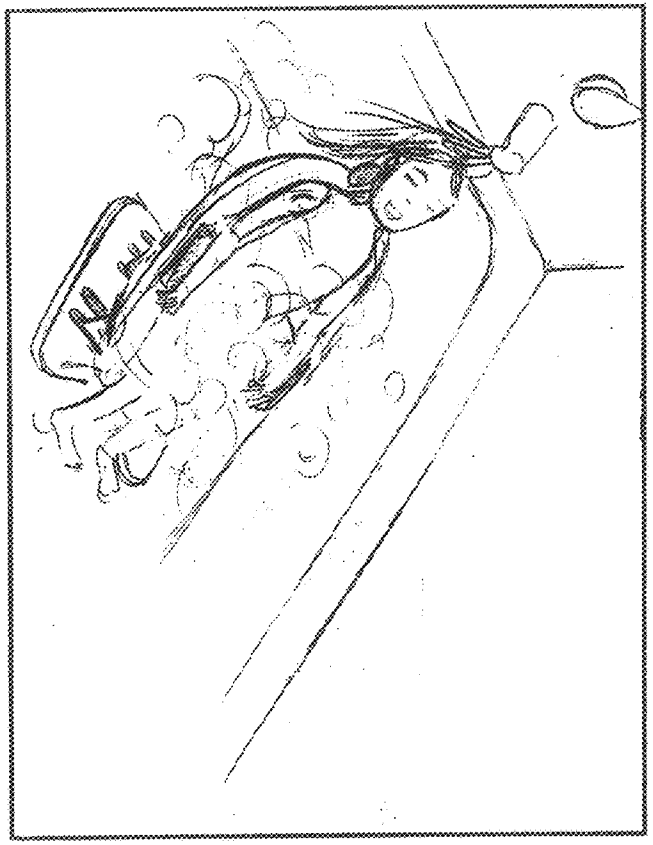

FIG. 4*b* is a pictorial representation of a toddler lying in the super deluxe bather for a bath, according to various embodiments described herein.

FIG. 5 illustrates a full, close-up view of the super deluxe bather in its entirety, according to various embodiments described herein.

In a preferred embodiment, the cover of the super deluxe bather may be light sage mixed with dark sage and white designs.

The super deluxe bather is used for both infants and toddlers.

FIG. 6 illustrates how portions of the super deluxe bather can be detached for utility, according to various embodiments described herein.

FIG. 7 illustrates how the super deluxe bather can fold up 702 for storage, according to various embodiments described herein.

FIG. 8 is a flow diagram illustrating a method for giving a bath to a child using a super deluxe bather, according to the embodiments as disclosed herein. The method begins at step 802.

In a preferred embodiment, the method described herein is suitable for toddlers up to six years.

At step 802, the super deluxe bather is placed in a common bathtub. The super deluxe bather can be easily unfolded and unlocked and place in the bathtub. The bather is positioned with headrest facing bathtub faucet.

At step 804, a headrest and a plurality of armrests are detached from the super deluxe bather.

At step 806, the headrest and the armrests are adjusted to ensure proper accommodation of the child.

The armrests are adjusted out in two positions for comfort and relaxation. The two positions are typically the sitting position and laying back position.

Similarly, the headrest is adjusted out in three different positions for comfortable position of the neck/head.

At step 808, the child is laid on the super deluxe bather for a relaxed and comfortable bath.

At step 810, a parent of the child is allowed to use both hands to bathe the child.

The method ends at step 810.

The method described herein is beneficial for several reasons as follows:

a. Provides infants and toddlers (preferably up to six years) with an adjustable bather.

b. Offers a more comfortable bathing experience for infants and toddlers by utilizing different adjustable mechanisms.

c. Allows parents to use both hands to bathe their children rather than holding up the body and neck underneath a bathtub faucet.

d. Provides adjustable armrests and headrest to accommodate children of different sizes.

e. Includes a mildew-resistant covering and extruded polystyrene foam for additional comfort and utility.

f. Does not cause pain to the child's back arms and neck.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suitable to the particular use contemplated.

Accordingly, the disclosure of the present invention is intended to be illustrative, but not limiting, of the scope of the invention, which is set forth in the following claims.

The invention claimed is:

1. An infant bather and toddler bather, for bathing of infants and toddlers up to 6-years of age, comprising:

b) a locking metal frame comprising:
   i) a base,
   ii) a back portion,
   iii) a pushbutton lock, and
   iv) a seat portion;

c) a detachable mesh seat;

d) a detachable-pivoting-adjustable fixed-size headrest;

e) a plurality of detachable-pivoting-adjustable fixed-size armrests; and g) a 3-position head-rest pin-position lock;

h) wherein said back portion and said seat portion of said locking metal frame comprise an adjustable seat that is structured and arranged with said detachable mesh seat and said pushbutton lock for adjusting among multiple different sitting locked-positions and multiple different lying locked-positions and that are further adjustable to accommodate the heights of an infant bather and an toddler up to 6-years of age;

i) wherein said base comprises a non-skid material that is structured and arranged with said locking metal frame for non-skid placement within a bathtub;

j) wherein said 3-position head-rest pin-position lock is structured and arranged with said detachable-pivoting fixed-size headrest, said locking metal frame and said pushbutton lock to position-lock, said detachable-pivoting fixed-size headrest for accommodating a height of the infant bather and a height of the toddler bather up to 6-years of age;

k) wherein said locking metal frame is structured and arranged with said detachable mesh seat and said pushbutton lock such that said infant bather and toddler bather folds and locks for storage;

l) wherein said plurality of detachable-pivoting-adjustable fixed-size armrests are structured and arranged with said locking metal frame for adjusting in two locked-positions; and m) wherein said plurality of detachable-pivoting-adjustable fixed-size armrests are structured and arranged with said locking metal frame to adjustably-support an arm of the infant bather and the toddler bather up to 6-years of age in a sitting locked-position and a laying-back locked-position.

2. The infant bather and toddler bather of claim 1 wherein said locking metal frame is structured and arranged with said detachable mesh seat and said pushbutton lock whereby said locking metal frame can be unfolded and unlocked prior to placing in a bathtub.

3. The infant bather and toddler bather of claim 1 wherein infant bather and toddler bather is structured and arranged to be selectably-adjustable for sitting locked-position and laying back locked-position of the infant bather and the toddler up to 6-years of age.

4. The infant bather and toddler bather of claim 1 wherein the headrest is structured and arranged to be attached to the locking metal frame and is movable when adjusting on the base portion.

5. The infant bather and toddler bather of claim 1 wherein said detachable-pivoting-adjustable fixed-size headrest is structured and arranged to be detachable and adjustable to a plurality of locked-positions.

6. The infant bather and toddler bather of claim 3 wherein said detachable-pivoting-adjustable fixed-size headrest is structured and arranged to be adjusted for washing the hair of the infant bather and the toddler up to 6-years of age.

7. The infant bather and toddler bather of claim 4 wherein said detachable-pivoting-adjustable fixed-size headrest is structured and arranged to be further adjusted to a plurality of lengths thereby accommodating the height of the infant bather and the toddler up to 6-years of age.

8. The infant bather and toddler bather of claim 3 wherein said plurality of detachable-pivoting-adjustable fixed-size armrests are structured and arranged to be detachable and adjustable to a plurality of positions.

9. The infant bather and toddler bather of claim 1 wherein said detachable-pivoting-adjustable fixed-size headrest and said plurality of detachable-pivoting-adjustable fixed-size armrests are composed of rust proof metal and covered with a foam material.

10. The infant bather and toddler bather of claim 9 wherein said detachable-pivoting-adjustable fixed-size headrest and said plurality of detachable-pivoting-adjustable fixed-size armrests are further covered with a quick-drying, mildew-resistant and washable fabric.

11. The infant bather and toddler bather of claim 1 wherein said locking metal frame is covered with a quick-drying, mildew-resistant and washable fabric.

12. The infant bather and toddler bather of claim 1 and further comprises a mildew-resistant covering and extruded polystyrene foam.

13. The infant bather and toddler bather of claim 1 wherein said infant bather and toddler bather is covered in washable, mildew-resistant fabric with a mesh seating area.

14. The infant bather and toddler bather of claim 1 wherein said base portion is structured and arranged with non-skid material and further structured and arranged with said locking metal frame to ensure that the infant bather and the toddler bather do not shift during bathing.

15. The infant bather and toddler bather of claim 1 wherein infant bather and toddler bather is structured and arranged to adapt for infants and toddlers up to 6-years of age.

16. The infant bather and toddler bather of claim 1 wherein an edge of said detachable mesh seat, said detachable-pivoting-adjustable fixed-size headrest, and said plurality of detachable-pivoting-adjustable fixed-size armrests are filled with styrofoam pieces.

17. A method for giving a bath to a bather using said infant bather and toddler bather of claim 1, said method comprising:

a) placing the bather in a bathtub;

b) detaching a detachable-pivoting-adjustable fixed-size headrest and a plurality of detachable-pivoting-adjustable fixed-size armrests from infant bather and toddler bather;

c) adjusting said detachable-pivoting-adjustable fixed-size headrest and said plurality of detachable-pivoting-adjustable fixed-size armrests to accommodate height of the bather;

d) laying the bather on said infant bather and toddler bather; and e) thereby enabling a parent of the bather to use both hands to bathe the child.

18. The method of claim 17 wherein the bather is a up to 6-years of age.

19. The method of claim 17 and further comprising:

a) utilizing said detachable-pivoting-adjustable fixed-size headrest and said plurality of detachable-pivoting-adjustable fixed-size armrests to offer a comfortable bathing experience for the bather up to 6-years of age.

20. The method of claim 17 and further comprising:

a) reclining infant bather and toddler bather to a sitting position and a laying-back position of the bather up to 6-years of age for bathing.

* * * * *